US009204669B2

(12) United States Patent
Taniguchi et al.

(10) Patent No.: US 9,204,669 B2
(45) Date of Patent: Dec. 8, 2015

(54) CIGARETTE FILTER, PROCESS FOR PRODUCING THE SAME, AND CIGARETTE

(75) Inventors: Hiroki Taniguchi, Himeji (JP); Masato Shigematsu, Himeji (JP); Takashi Ikebe, Sakai (JP); Toshiyuki Morioka, Himeji (JP)

(73) Assignee: Daicel Corporation, Osaka (JP)

( * ) Notice: Subject to any disclaimer, the term of this patent is extended or adjusted under 35 U.S.C. 154(b) by 948 days.

(21) Appl. No.: 13/281,094

(22) Filed: Oct. 25, 2011

(65) Prior Publication Data

US 2012/0103352 A1 May 3, 2012

(30) Foreign Application Priority Data

Nov. 1, 2010 (JP) ..... 2010-245501

(51) Int. Cl.
*A24D 3/04* (2006.01)
*A24D 3/10* (2006.01)
*A24D 3/06* (2006.01)

(52) U.S. Cl.
CPC . *A24D 3/10* (2013.01); *A24D 3/062* (2013.01)

(58) Field of Classification Search
CPC ..... A24D 3/10; A24D 3/062
USPC ..... 131/342, 345
See application file for complete search history.

(56) References Cited

U.S. PATENT DOCUMENTS 3,021,242 A * 2/1962 Touey ..... 156/180
3,420,245 A 1/1969 Kiefer et al.
3,428,055 A 2/1969 Sublett et al.
5,856,006 A 1/1999 Asai et al.
2004/0200490 A1 10/2004 Inagaki et al.
2006/0213533 A1 9/2006 Emami
2009/0272392 A1 11/2009 Liu et al.
2010/0242977 A1 9/2010 Tarora et al.
2013/0255704 A1 10/2013 Sampson et al.

FOREIGN PATENT DOCUMENTS

CN 1482142 A 3/2004
GB 1190224 A 4/1970
JP 8-47385 A 2/1996
JP 2001-526913 A 12/2001
JP 3576222 B2 7/2004
JP 2006-191813 A 7/2006
JP 3910175 B2 4/2007
JP 2007-319041 A 12/2007

(Continued)

OTHER PUBLICATIONS

Chinese Office Action issued Oct. 24, 2014 in Chinese Patent Application No. 201110339701.4.

(Continued)

*Primary Examiner* — Richard Crispino
*Assistant Examiner* — Dionne W Mayes
(74) *Attorney, Agent, or Firm* — Birch, Stewart, Kolasch & Birch, LLP

(57) ABSTRACT

A cigarette filter comprises a cellulose ester tow and a cellulose acetate particle dispersed in the cellulose ester tow, and the cellulose acetate particle has the following particle size: not less than 90% by weight of the cellulose acetate particle pass through a sieve having an aperture size of 1.7 mm and fail to pass through a sieve having an aperture size of 0.10 mm, and these sieves are in accordance with JIS Z8801-1 2006.

13 Claims, 1 Drawing Sheet

(56) References Cited

FOREIGN PATENT DOCUMENTS

| | | | |
|---|---|---|---|
| JP | 2008-154509 | A | 7/2008 |
| JP | 2010-35550 | A | 2/2010 |
| JP | 2010-533482 | A | 10/2010 |
| WO | WO 99/33365 | A1 | 7/1999 |
| WO | WO 03/037114 | A1 | 5/2003 |
| WO | WO 2006/117862 | A1 | 1/2006 |
| WO | WO 2009/010380 | A2 | 1/2009 |
| WO | WO 2009/024866 | A2 | 2/2009 |
| WO | WO 2009/078287 | A1 | 6/2009 |

OTHER PUBLICATIONS

Dietrich Hoffman et al., "Filtration of Phenols From Cigarette Smoke"; Journal of the National Cancer Institute, vol. 30, No. 1, pp. 67-84, Published Jan. 31, 1963.

* cited by examiner

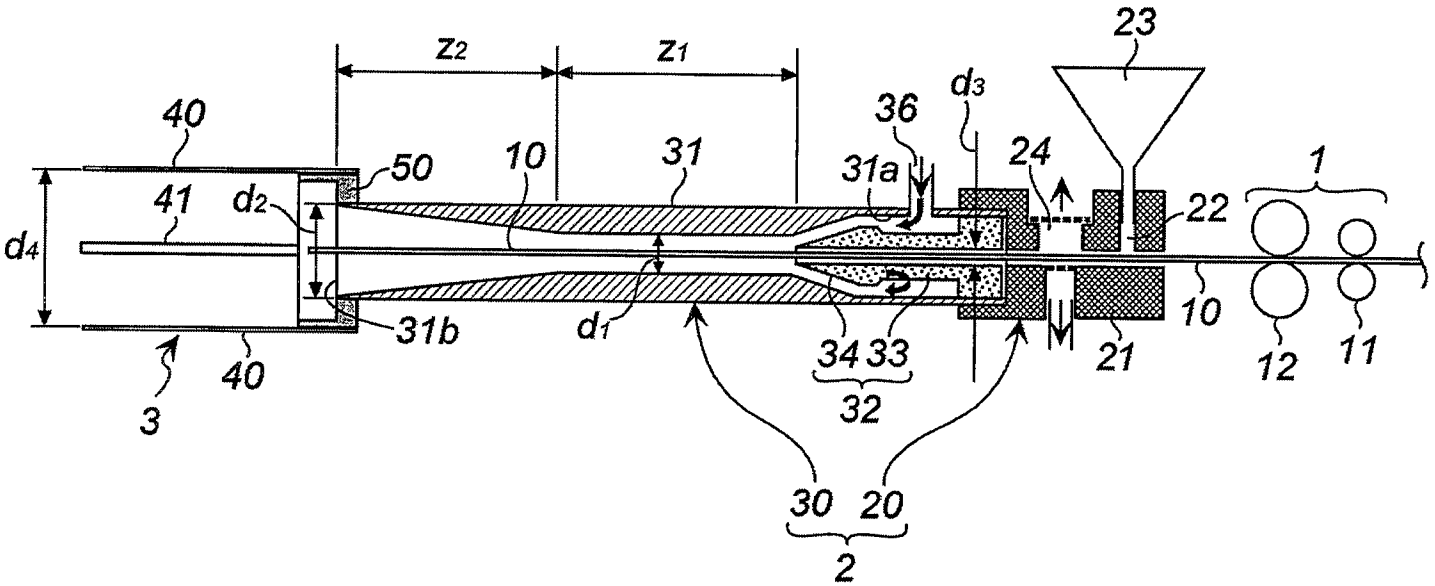
1
11
12
10
22
23
21
24
$d_3$
36
31a
33
34
32
20
2
30
$z_1$
31
$d_1$
10
$z_2$
50
31b
$d_2$
40
40
41
3
$d_4$

CIGARETTE FILTER, PROCESS FOR PRODUCING THE SAME, AND CIGARETTE

FIELD OF THE INVENTION

The present invention relates to a cigarette filter for selectively and efficiently removing a phenol compound (in particular, phenol) while maintaining a palatable component such as nicotine or tar, a process for producing the cigarette filter, and a cigarette provided with the cigarette filter.

BACKGROUND OF THE INVENTION

Nowadays, in relation to health effects of smoking, a technique for reducing a harmful component in cigarette smoke is demanded in the cigarette field. Cigarette smoke contains various harmful components. Above all, a phenol compound such as phenol or cresol is a harmful substance which is contained in a relatively high concentration in the smoke, and effective removal of the phenol compound is desired. In order to adsorb the harmful substance, an activated carbon is widely used conventionally. However, physical adsorption, typically using an activated carbon, removes not only the harmful substance but also a palatable component in cigarette smoke. In other words, removal of nicotine, tar, and other flavor components changes the taste of cigarette smoke, so that a feeling of satisfaction in smoking is inhibited. Moreover, the activated carbon has a low capacity to adsorb the phenol compound. As a technique for producing a cigarette filter by adding an activated carbon to a tow comprising a cellulose acetate, the following technique is usually applied: a tow having a crimp undergo a tension between two pairs of rollers, each moving at a different speed, to be stretched, and the resulting tow is sprinkled with a charcoal, and then the charcoal is attached to the tow with a plasticizer such as triacetin to give a cigarette filter. However, according to this technique, the amount of the activated carbon attached is difficult to increase. In addition, the activated carbon adsorbs triacetin, so that the adsorbing capacity of the activated carbon is decreased.

On the other hand, currently, a cellulose acetate tow is commonly used for a cigarette filter. Although a filter made from the cellulose acetate tow can reduce a phenol content of mainstream cigarette smoke, the reduction is unsatisfactory. Thus, a method for selectively adsorb a phenol compound from mainstream cigarette smoke by a filter made from a cellulose acetate tow is desired.

Japanese Application Laid-Open No. 2001-526913 publication (JP-2001-526913A, Patent Document 1) discloses a cigarette filter which contains a polyphenol compound or a derivative thereof (such as an extract of rosemary) as a free-radical scavenger for removing a cytotoxic molecule having a free radical existing in cigarette smoke. Moreover, Japanese Patent No. 3910175 publication (JP-3910175B, Patent Document 2) discloses a cigarette filter for removing a phenol compound in mainstream smoke, the filter comprising the following three filter sections (A) to (C): (A) a filter section added with a liquid fatty acid ester or a liquid fatty acid, having a viscosity of 1 to 300 cP, (B) a filter section added with a glycol having a viscosity of 1 to 300 cP, and (C) a filter section added with an activated carbon and provided on a downstream side of the filter section (A) and the filter section (B).

However, in these cigarette filters, since the liquid substances are added to these filters, the liquid substances are scattered or moved to a tobacco-leaf zone during cigarette storage.

Japanese Patent Application Laid-Open No. 2006-191813 publication (JP-2006-191813A, Patent Document 3) discloses a smoking article for reducing a CO concentration and a $NO_x$ concentration in mainstream cigarette smoke. The smoking article comprises a rod-like core, a sheath formed by surrounding the core with shredded tobacco, and a tube covering the sheath, the core comprises a porous material charged in a partial portion or all portions of the core in a longitudinal direction thereof, and the air resistance (or draw resistance) of the core is lower than that of the sheath. The document discloses alumina, silica, and zeolite as a raw material for the porous material.

In the smoking article, the porous material is used not for a filter but for a tobacco-leaf zone, so that the porous material inevitably comprises an inorganic material. However, the inorganic material insufficiently adsorbs a phenol compound.

As a material for selectively and efficiently removing an aldehyde (in particular, formaldehyde) while maintaining a palatable component such as nicotine or tar, Japanese Patent Application Laid-Open No. 2008-154509 publication (JP-2008-154509A, Patent Document 4) discloses a cigarette filter material which comprises a porous material having an average pore size of 5 to 350 nm, such as a silica gel. Japanese Patent Application Laid-Open No. 2010-35550 publication (JP-2010-35550A, Patent Document 5) discloses a cigarette filter material which comprises a porous silica having a total nitrogen content of not more than 1% by weight, a total carbon content of not more than 20% by weight, an average pore size of 2 to 50 nm, a specific surface area of 500 to 1300 $m^2/g$, and a pore of a hexagonal structure. According to these documents, a produced filter has a triplet structure that a gap in the divided filter is filled with the filter material.

However, damage to these filters having a triplet structure involves a risk of getting a scattered particulate porous material in the eyes or the lungs. Moreover, the triplet structure cannot improve the filter hardness.

On the other hand, as a filter mainly comprising a cellulose having a paper structure, Japanese Patent No. 3576222 publication (JP-3576222B, Patent Document 6) discloses a cigarette filter material in the form of a sheet which comprises a particulate or non-crimped fibrous cellulose ester and a wood pulp having a Canadian standard freeness value of 100 to 800 ml in a ratio of the former/the latter=15/85 to 80/20 (% by weight).

However, since the main body of this filter comprises the wood pulp (cellulose), the filter has an insufficient phenol removal and a low filter hardness. Moreover, although the filter hardness can be improved by increasing the ratio of the particulate cellulose ester relative to the wood pulp, the pressure drop is also increased. Thus, there is a limit in weight increase of the particulate cellulose ester. Further, the particulate cellulose ester is easily eliminated from the filter.

[Patent Document 1] JP-2001-526913A (Claims and Examples)

[Patent Document 2] JP-3910175B (Claim 1 and Examples)

[Patent Document 3] JP-2006-191813A (Claim 1 and Paragraphs [0011] and [0013])

[Patent Document 4] JP-2008-154509A (Claims, Paragraphs [0001] and [0044], and Examples)

[Patent Document 5] JP-2010-35550A (Claims, Paragraphs [0001] and [0054], and Examples)

[Patent Document 6] JP-3576222B (Claim 1)

SUMMARY OF THE INVENTION

It is therefore an object of the present invention to provide a cigarette filter for selectively and efficiently removing a phenol compound (e.g., phenol and cresol) while maintaining a palatable component such as nicotine or tar, a process for producing the cigarette filter, and a cigarette provided with the cigarette filter.

Another object of the present invention is to provide a cigarette filter having a high hardness while maintaining a moderate air resistance (pressure drop), a process for producing the cigarette filter, and a cigarette provided with the cigarette filter.

It is still another object of the present invention to provide a cigarette filter in which elimination of a cellulose acetate particle can be prevented in spite of a large amount of a cellulose acetate particle, a process for producing the cigarette filter, and a cigarette provided with the cigarette filter. It is a further object of the present invention to provide a cigarette filter having a selective adsorption substance added thereto, the selective adsorption substance having an adsorbing capacity which is not decreased by a plasticizer (such as triacetin) for a cellulose acetate. Moreover, it is a still further object of the present invention to provide a cigarette filter having a larger amount of an adsorption substance added thereto.

The inventors of the present invention made intensive studies to achieve the above objects and finally found that a phenol compound (e.g., phenol and cresol) can selectively and efficiently be removed while maintaining a palatable component (e.g., nicotine and tar) by dispersing a cellulose acetate particle having a specific particle size in a cellulose ester tow. The present invention was accomplished based on the above findings.

That is, the cigarette filter of the present invention comprises a cellulose ester tow and a cellulose acetate particle dispersed in the cellulose ester tow, and the cellulose acetate particle has the following particle size: not less than 90% by weight of the cellulose acetate particle pass through a sieve having an aperture size of 1.7 mm and fail to pass through a sieve having an aperture size of 0.10 mm, and these sieves are in accordance with JIS (Japanese Industrial Standards) Z8801-1 2006. The cigarette filter of the present invention may further contain a plasticizer, and the ratio of the plasticizer may be about 1 to 10 parts by weight relative to 100 parts by weight of the cellulose ester tow, and the cellulose acetate particle may be fixed to cellulose ester tow with the plasticizer. The plasticizer may comprise an acetin compound. The cellulose ester tow may comprise a cellulose acetate tow. The cellulose ester tow may have an average fineness of about 10000 to 50000 deniers, and a filament of the tow may have an average fineness of about 1 to 10 deniers. The ratio of the cellulose acetate particle may be about 100 to 500 parts by weight relative to 100 parts by weight of the cellulose ester tow. The cellulose acetate particle may have the following particle size: not less than 90% by weight of the cellulose acetate particle pass through a sieve having an aperture size of 1.0 mm and fail to pass through a sieve having an aperture size of 0.18 mm, and these sieves are in accordance with JIS Z8801-1 2006. The cigarette filter of the present invention may have a BET specific surface area (a specific surface area measured by BET method) of about 0.5 to 10 $m^2/g$. The cigarette filter of the present invention has a high hardness and a low pressure drop. The cigarette filter may have a thickness retention of not less than 90% under a load of 300 g and have an air resistance of not more than 1000 mmWG at an air flow rate of 17.5 ml/second in a filter rod having a length of 100 mm and a diameter of 8 mm. The cigarette filter of the present invention may have a reducing rate of phenol of not less than 10% in accordance with Test Method T-114 of Health Canada. The cigarette filter of the present invention may be substantially free from a chitosan or a salt thereof.

The present invention also includes a process for producing the cigarette filter, which comprises a step for adding a cellulose acetate particle to an opened cellulose ester tow. When the ratio of the cellulose acetate particle is high in this process, after addition of the cellulose acetate particle to a preliminarily opened cellulose ester tow, the cellulose ester tow may be further opened by an airflow.

Further, the present invention includes a cigarette provided with the cigarette filter.

BRIEF DESCRIPTION OF THE DRAWINGS

FIG. 1 is a schematic cross-sectional view of an example of an apparatus for producing a filter of the present invention in accordance with an embodiment of the present invention.

DETAILED DESCRIPTION OF THE INVENTION

The cigarette filter of the present invention comprises a cellulose ester tow and a cellulose acetate particle having a specific particle size and has a structure that the cellulose acetate particle is dispersed in the cellulose ester tow (what is called a dalmatian structure).

[Cellulose Ester Tow]

The cellulose ester tow is a fiber bundle which is formed with a cellulose ester fiber and has a tow structure or a filter rod structure. Specifically, the cellulose ester tow is a fiber bundle having a structure that a monofilament comprising a cellulose ester is sheaved (a multifilament structure having a substantially infinite continuous length). Concretely, the cellulose ester tow is formed by bundling (or sheaving), for example, about 3,000 to 1,000,000, preferably about 3,000 to 100,000, and more preferably about 5,000 to 100,000 single fibers (monofilaments).

The average fineness (total denier) of the cellulose ester tow is, for example, about 10000 to 50000 deniers, preferably about 20000 to 48000 deniers, and more preferably about 25000 to 45000 deniers (particularly about 30000 to 43000 deniers).

The average fineness of the single fiber (monofilament) constituting the cellulose ester tow is, for example, about 1 to 10 deniers, preferably about 1.2 to 8 deniers, and more preferably 1.5 to 5 deniers (particularly about 1.8 to 3 deniers). The average fiber length of the monofilament may be selected from the range of about 0.1 mm to 5 cm and is, for example, about 0.5 to 30 mm, preferably about 1 to 20 mm, and more preferably about 3 to 15 mm (particularly about 5 to 10 mm).

The shape at cross section in the monofilament is not particularly limited to a specific one, and may for example be any form such as an irregular form (e.g., Y-shaped form, X-shaped form, I-shaped form, R-shaped form, and H-shaped form) or a shape at cross section of hollow fiber. The shape at cross section is preferably a polygonal irregular form such as Y-shaped form, X-shaped form, I-shaped form, R-shaped form, or H-shaped form. The monofilament is preferably a crimped fiber.

The cellulose ester constituting the cellulose ester fiber is usually a cellulose acetate. However, within a range that the present invention can be achieved, the cellulose ester may contain a small amount of a mixed ester of a cellulose with organic acids each having about 2 to 4 carbon atoms. Such a cellulose ester may include a cellulose acetate propionate, a cellulose acetate butyrate, and others.

Moreover, the substitution degree (average substitution degree) of the cellulose ester (particular, a cellulose acetate)

may be, for example, selected from the range of about 1 to 3 (e.g., about 1 to 2.9) and may be preferably about 1.5 to 2.7 and more preferably about 2.2 to 2.6.

[Cellulose Acetate Particle]

According to the present invention, the particle size of the cellulose acetate particle (raw material basis) is 1.7 to 0.10 mm in a method in accordance with JIS Z8801-1 2006. That is, the cellulose acetate particle in the present invention has the following particle size: not less than 90% by weight of the total particle pass through a sieve having an aperture size of 1.7 mm and fail to pass through a sieve having an aperture size of 0.10 mm. Further, the particle size of the cellulose acetate particle in the present invention is preferably 1.7 to 0.18 mm and particularly preferably 1.0 to 0.18 mm. When the particle size is within the range, the filter has a high reducing rate of phenol and an improved filter hardness without significantly deteriorating the pressure drop.

The average particle size of the cellulose acetate particle is, for example, about 0.1 to 2 mm, preferably about 0.2 to 1 mm, and more preferably about 0.3 to 0.8 mm.

Examples of the shape of the cellulose acetate particle may include a spherical form, an ellipsoidal form, a polygonal form (e.g., a polyangular-pyramid form, a cubic form, and a rectangular-prism form), a plate-like or scaly (flake) form, a rod-like form, and an amorphous form. In view of filter properties, dispersibility, or others, an isotropic form, such as an almost spherical form, is preferred. Further, the cellulose acetate particle may be porous.

The particle size and shape of the cellulose acetate particle may be changed in the cellulose ester tow by addition of a plasticizer. In the present invention, the particle size and shape are determined on the basis of those of the cellulose acetate particle before the particle is added to the cellulose ester tow (that is, on the basis of those of the raw material).

The specific surface area of the cellulose acetate particle measured by BET method (BET specific surface area) may be selected from the range of about 0.1 to 100 $m^2/g$ and may for example be about 1 to 50 $m^2/g$, preferably about 3 to 30 $m^2/g$, and more preferably about 5 to 20 $m^2/g$ (particularly about 8 to 15 $m^2/g$).

The bulk specific gravity of the cellulose acetate particle may for example be about 0.1 to 0.6 $g/cm^3$, preferably about 0.2 to 0.55 $g/cm^3$, and more preferably about 0.3 to 0.5 $g/cm^3$.

The acetylation degree of the cellulose acetate may for example be selected from the range of about 29 to 62.5% (e.g., about 29 to 62%) and may be preferably about 40 to 59% and more preferably about 44 to 58%.

The polymerization degree (viscosity-average polymerization degree) of the cellulose acetate may usually be, for example, about 10 to 1000 (e.g., about 50 to 1000), preferably about 50 to 900 (e.g., about 100 to 800), and more preferably about 200 to 800.

The ratio of the cellulose acetate particle relative to 100 parts by weight of the cellulose ester tow may be selected from the range of about 10 to 1000 parts by weight and may for example be about 20 to 500 parts by weight (particularly about 30 to 400 parts by weight). Further, according to the present invention, even when the ratio of the cellulose acetate particle is increased, both hardness and phenol-removal rate of the filter can be improved without significantly increasing the pressure drop. Accordingly, the ratio of the cellulose acetate particle may for example be about 100 to 500 parts by weight (particularly about 200 to 400 parts by weight) relative to 100 parts by weight of the cellulose ester tow.

[Plasticizer]

According to the present invention, the plasticizer not only improves the formability (moldability) of the cellulose ester tow but also allows uniform dispersion of the cellulose acetate particle. In addition, the plasticizer also plays a role in fixing the cellulose acetate particle to the cellulose ester tow probably due to attachment of the cellulose acetate particle to the plasticized tow.

As the plasticizer, for example, a compound having a high affinity with an ester group (e.g., acetyl group) of the cellulose ester is preferred. For example, a fatty acid ester of a polyol or a fatty acid ester of a polyol oligomer can be used as the plasticizer. Concrete examples of the plasticizer may include an ester of a polyol with a lower fatty acid (e.g., a $C_{1-4}$alkanecarboxylic acid such as acetic acid) (for example, a $C_{3-6}$alkanetriol-mono- to tri$C_{1-4}$acylate such as monoacetin, diacetin, or triacetin, preferably a glycerin mono- to tri$C_{2-3}$acylate) and an ester of a polyol oligomer with a lower fatty acid (e.g., a di$C_{3-6}$alkanetriol-mono- to tetra$C_{1-4}$acylate such as diglycerin tetraacetate). These plasticizers may be used alone or in combination.

Among these plasticizers, in view of an improved formability of the cellulose ester tow as well as an excellent affinity with the cellulose acetate particle, an acetin compound (e.g., a glycerin di- or triacetate such as diacetin or triacetin), particularly triacetin, is preferred. The plasticizer such as an acetin compound not only plays a conventional role (improvement in formability of the tow) but also allows a uniform dispersion of the cellulose acetate particle in the tow and fixation of the cellulose acetate particle to the cellulose ester tow through the plasticizer.

The ratio of the plasticizer relative to 100 parts by weight of the cellulose ester tow is, for example, about 0.1 to 20 parts by weight, preferably about 1 to 10 parts by weight, and more preferably about 2 to 8 parts by weight (particularly about 5 to 7 parts by weight).

[Cigarette Filter]

The cigarette filter of the present invention has a structure that the cellulose acetate particle is dispersed in the cellulose ester tow (a dalmatian structure). The dispersion state (or pattern) of the cellulose acetate particle is not particularly limited to a specific one and may for example be a state in which the concentration of the particle in a core of the tow is higher than that in another region. In view of the filter properties and others, a state in which the particle is almost uniformly dispersed in the tow is preferred.

The BET specific surface area of the cigarette filter of the present invention may for example be about 0.5 to 10 $m^2/g$, preferably about 1 to 10 $m^2/g$, and more preferably about 2 to 10 $m^2/g$ (particularly about 5 to 10 $m^2/g$). According to the present invention, since the filter can contain the cellulose acetate particle in a high concentration, the filter can also have an improved specific surface area and excellent filter properties.

The cigarette filter of the present invention has a high filter hardness due to the cellulose acetate particle contained therein. The thickness retention of the cigarette filter under a load of 300 g is not less than 88%, for example, not less than 90% (e.g., about 90 to 99.5%), preferably about 91 to 99%, and more preferably about 92 to 98% (particularly about 93 to 97%). According to the present invention, the filter hardness can be adjusted to about 93 to 97% (particularly about 94 to 96%) by adding not less than 100 parts by weight (particularly not less than 200 parts by weight) of the cellulose acetate particle to 100 parts by weight of the cellulose ester tow.

The cigarette filter of the present invention has a low pressure drop in addition to a high filter hardness as described above. The cigarette filter has an air resistance (pressure drop) of not more 1500 mmWG (water gauge) at an air flow rate of 17.5 ml/second in a filter rod having a length of 100 mm and a diameter of 8 mm. The air resistance may be not more than 1000 mmWG and is, for example, about 420 to 1000 mmWG, preferably about 420 to 900 mmWG, and more preferably about 420 to 800 mmWG (particularly about 420 to 600 mmWG). According to the present invention, a filter having a moderate pressure drop while inhibiting an extreme increase in air resistance can be prepared, even when a large amount of the cellulose acetate particle is added to the tow to improve the filter hardness.

The cigarette filter of the present invention has an excellent removal efficiency of phenol and a reducing rate of phenol of not less than 5% in accordance with Test Method T-114 of Health Canada. The above-mentioned reducing rate of phenol may be not less than 10% (e.g., about 10 to 80%) and is, for example, not less than 20% (e.g., about 20 to 70%), preferably not less than 30% (e.g., about 30 to 60%), and more preferably not less than 40% (e.g., about 40 to 55%). According to the present invention, the cigarette filter has an excellent permeability to a palatable component (such as nicotine or tar) and does not weaken a unique (or original) taste of cigarette due to a tow structure thereof, which is easily permeable to a floating fine particle, in addition to such a high reducing rate of phenol.

The cigarette filter may contain a conventional additive, for example, an organic substance such as a perfume (e.g., menthol). Moreover, in order to improve the color tone of the filter, the cigarette filter may contain an inorganic particle (e.g., kaolin, talc, zeolite, diatomaceous earth, silica gel, quartz, calcium carbonate, barium sulfate, titanium oxide, alumina, and zirconia). In particular, the cigarette filter preferably contains titanium oxide. Further, in view of easy spinning operation, the cellulose acetate may contain an oil.

In order to further improve the removal of the harmful component, the cigarette filter of the present invention may contain a conventional adsorbent, a chitosan or a salt thereof, a perfume, and others. However, since the cigarette filter contains the cellulose acetate particle having a specific particle size and can efficiently remove the harmful component such as a phenol compound, the cigarette filter may be substantially free from an adsorption substance such as a chitosan or a salt thereof.

The cigarette of the present invention is provided with (or comprises) the cigarette filter having such properties. The site to be disposed of the cigarette filter is not particularly limited to a specific one. In a cigarette shaped in the form of a rod by a wrapper, the cigarette filter is often disposed in the mouthpieth or between the mouthpieth and paper-wrapped cigarette. Incidentally, the periphery of the cross section of the cigarette corresponds to that of the cross section of the filter in many cases, and may usually be about 15 to 30 mm and preferably about 17 to 27 mm.

[Process for Producing Cigarette Filter]

The cigarette filter of the present invention can be obtained by mixing a cellulose acetate particle (and optionally a plasticizer such as an acetin compound) to a cellulose ester tow obtained according to a conventional spinning method (dry spinning, melt spinning, or wet spinning). For example, using an existing apparatus for producing a cigarette filter, the cigarette filter can be shaped by opening a bale of a cellulose ester tow, adding a plasticizer to the opened tow with an apparatus for adding a plasticizer, further adding a cellulose acetate particle to the tow with an apparatus for adding an activated carbon (charcoal-adding system or mechanism), bundling (or sheaving) the tow at a given diameter, and wrapping the resulting bundled tow in paper for fixation with a filter rod maker to give a filter plug (bundle).

According to the present invention, for addition of a large amount of the cellulose acetate particle (for example, not less than 150 parts by weight relative to 100 parts by weight of the cellulose ester), in order to allow the cellulose acetate particle to uniformly disperse and maintain (or hold) in the tow, the cellulose ester tow may be further opened by an airflow after adding the cellulose acetate particle to a preliminarily opened cellulose ester tow. In this process, a larger amount of the cellulose acetate particle can be added compared with the conventional method for a charcoal filter (that is, addition of a particle to an opened cellulose ester tow). Additionally, in this process, since the cellulose acetate particle is filled (jet filled) in the cellulose ester tow under stirring while opening the tow by an airflow in a state where the cellulose ester tow is in contact with the cellulose acetate particle, for example, even not less than 200 parts by weight (e.g., about 200 to 500 parts by weight) of the cellulose acetate particle relative to 100 parts by weight of the cellulose ester can uniformly be dispersed in the cellulose tow.

As a production apparatus for carrying out such a process, for example, an improved version of an apparatus which is capable of opening a preliminarily opened tow by an airflow (for example, a production apparatus described in Japanese Patent Application Laid-Open No. 2008-255529 publication (JP-2008-255529A)) may be utilized. Specifically, there may be utilized an improved apparatus which comprises a production apparatus described in FIG. 1 of JP-2008-255529A and an addition device equipped with the production apparatus, where the addition device is used for adding a cellulose acetate particle to a preliminarily opened tow before airflow introduction. FIG. 1 represents an example of the production apparatus equipped with the addition device.

As this apparatus shown in FIG. 1, in a preliminarily opening unit 1, a crimped tow drawn (or pulled out) from a bale of a cellulose ester tow is continuously fed between two pairs of preliminarily opened rollers 11, 12, so that the crimped tow is preliminarily opened. Specifically, the preliminarily opening can be made by disposing the roller 11 having a smaller diameter upstream of the roller 12 having a larger diameter. The process of preliminarily opening is detailed in JP-2008-255529A.

Next, a cellulose acetate particle is added to a preliminarily opened cellulose ester tow 10 in an opening unit 2, and then the tow 10 is further opened by an airflow. More specifically, while continuously feeding the tow 10 to an almost cylindrical addition device 20 of the opening unit 2, the cellulose acetate particle is added to the preliminarily opened tow 10 through a particle-introducing hole 22 from a hopper 23 equipped with an addition device body 21. According to this process, addition of the cellulose acetate particle through the particle-introducing hole 22 allows sufficient contact of the preliminarily opened tow 10 with the cellulose acetate particle while passing through the addition device 20, so that the cellulose acetate particle is easily held in (or supported to) a preliminarily opened product of the tow 10. Thus, the cellulose acetate particle can also be held in large quantity compared with the weight of the tow.

The addition device body 21 further has a deaerating hole 24 formed downstream of the particle-introducing hole 22. The deaerating hole 24 discharges an air at the after-mentioned opening unit 30 and may have the same shape as a well-known vent hole (e.g., a vent hole disposed in a well-known extruder for molding a resin).

Moreover, in the opening unit 30, the tow 10 contacted with the cellulose acetate particle is further opened by an airflow. More specifically, in the addition device 20, the fiber tow 10 contacted with the cellulose acetate particle is passed through inside a cylindrical passage-forming part 32 disposed in the side of the addition device within a hollow cylindrical tube (nozzle body) 31 and is fed to a first opening zone $Z_1$ of the hollow cylindrical tube 31. The cylindrical passage-forming part 32 controls an airflow and comprises a shaft 33 and an arrowhead 34. The internal surface of the hollow cylindrical tube corresponds to the shape of the cylindrical passage-forming part 32, and the inside diameter corresponding to the shape is decreased toward the downstream of the arrowhead 34. That is, an airflow for opening the tow 10 is introduced into the hollow cylindrical tube 31 from an air-feeding hole 36 formed on a portion corresponding to the shaft 33 in a side wall of the hollow cylindrical tube 31, and the airflow in a flow direction of the tow 10 is passed through a space having a uniform width formed between the external wall of the shaft 33 and the arrowhead 34 and the internal wall 31*a* of the hollow cylindrical tube 31 to collide with the tow 10 uniformly. Thus, the airflow fed through the air-feeding hole 36 directs a flow thereof toward the next step, that is, an expanding and shaping unit 3 (an opened orifice 31*b* of the opening unit 30), along the axial direction of the opening unit. In this state, the airflow is in contact with the tow 10 fed to first opening zone $Z_1$ from the cylindrical passage-forming part 32, so that the tow 10 is expanded and opened in a thickness direction thereof by air pressure. In view of a stable feeding and productivity of the tow, the space between the external wall of the shaft and the arrowhead and the internal wall of the hollow cylindrical tube may be about 0.3 to 1.0 mm. The pressure of the airflow may for example be about 0.1 to 0.3 MPa (particularly about 0.1 to 0.2 MPa).

Moreover, the pressure difference between the upstream of the cylindrical passage-forming part 32 (the upstream passage) and the downstream thereof (the first opening zone $Z_1$) generated by the airflow introduced through the air-feeding hole 36 disappears by discharging an air through the deaerating hole 24, so that the cylindrical passage-forming part maintains an atmospheric pressure at the upstream and downstream thereof. Thus, the cellulose acetate particle is prevented from scattering caused by a higher pressure in the downstream, and the amount to be added of the cellulose acetate particle can be increased. The tow 10 opened by the airflow is passed through the first opening zone $Z_1$ of the hollow cylindrical tube 31 and then fed to a second opening zone $Z_2$. In this apparatus, the inside diameter $d_1$ of the first opening zone $Z_1$ is uniform in an axial direction thereof, while the inside diameter of the second opening zone $Z_2$ is increased toward a downstream direction thereof.

According to the present invention, the inside diameter $d_3$ of the cylindrical passage-forming part 32 is about 5 to 30 mm (particularly about 5 to 25 mm). The ratio of the inside diameter $d_1$ of the first opening zone $Z_1$ relative to the inside diameter $d_3$ ($d_1/d_3$) may be about 1 to 5. Further, the ratio of the outlet inside diameter $d_2$ of the second opening zone $Z_2$ relative to the inside diameter $d_1$ ($d_2/d_1$) may be about 1.5 to 2.

With respect to the basic shape and mechanism of the opening unit 30, the same shape and mechanism as those of the opening unit described in JP-2008-255529A may be used.

Finally, in the expanding and shaping unit 3, the cellulose ester tow 10 passed through the second opening zone $Z_2$ is shaped while expanding. The expanding and shaping unit 3 comprises a hollow almost cylindrical reservoir 40 and a rod-like core 41 extending to a central-axial direction thereof, and is connected to the opened orifice 31*b* of the opening unit 30 through an adapter 50. The reservoir 40 comprises a plurality of long flat springs extending to a central-axial direction thereof and has a space between two adjacent flat springs (not shown), and an air is released from the spaces. The inside diameter $d_4$ of the expanding and shaping unit 3 is so designed that the inside diameter $d_4$ is substantially larger than the outside diameter of the hollow cylindrical tube 31. The inside diameter $d_4$ of the expanding and shaping unit 3 relative to the outside diameter of the hollow cylindrical tube 31 is not less than 1 (e.g., about 1 to 1.4). The length of the expanding and shaping unit 3 (the length of the reservoir 40) may for example be about 150 to 350 mm.

In the expanding and shaping unit 3 having such a structure, the opened product of the tow 10 (opened tow) is held by the core 41 to avoid weighing down by gravity while the opened tow is temporarily expanded and retained in the unit 3. In addition, after the opened tow is shaped into a rod form by controlling the expansion with reservoir 40, the resulting rod-shaped product is extruded continuously to give a long opened tow (an expanded product of the opened tow). The resulting long opened tow is introduced into a trumpet-shaped collecting tube and is rolled up with a web paper according to a conventional manner to give a filter rod. In such a step, the retention of the tow in the unit allows the cellulose acetate particle to be held within the opened product of the tow 10 without scattering.

As the reservoir, for example, the reservoir described in JP-2008-255529A can be used. The shape or material of the reservoir is not particularly limited to a specific one as far as the form of the tow can be adjusted while preventing an excess expansion of the opened tow. The suitable shape of the reservoir is a plate-like form, a rod-like form, and others. The suitable material of the reservoir is a metal, a synthetic resin, and others (particularly, a metal). For example, the reservoir may be a rod-like reservoir made from a metal, and a plate-like reservoir made from a synthetic resin.

According to the present invention, since the cellulose acetate particle having the specific particle size is dispersed in the cellulose ester tow, a phenol compound (such as phenol or cresol) can selectively and efficiently be removed while maintaining a palatable component (such as nicotine or tar). Moreover, since a large amount of the cellulose acetate particle can be added to the tow, the resulting filter has a high hardness while maintaining a moderate air resistance (pressure drop). Further, use of a plasticizer containing an acetin compound can prevent elimination of the cellulose acetate particle in spite of a large amount of the cellulose acetate particle.

The cigarette filter of the present invention is available as a cigarette filter for a paper-wrapped cigarette, and the like.

EXAMPLES

The following examples are intended to describe this invention in further detail and should by no means be interpreted as defining the scope of the invention. In the following Examples and Comparative Examples, cigarette samples were made in accordance with the following methods, and properties (a particle size, an air resistance, a removal amount of phenol, and a filter hardness) were measured in accordance with the following methods.

[Production of Cigarette Sample]

In a filter body (25 mm) of a cellulose diacetate crimped fiber tow of a commercially available cigarette ["Peace Light Box" (Registered Trademark No. 2122839) manufactured by Japan Tobacco, Inc.], part of the filter body (20 mm from the end) was cut with a razor. The obtained longer piece (that is, a piece containing a tobacco leaf-filled part) was inserted to a glass tube having a length of 20 mm and an internal diameter of 8 mm in order that the remaining filter (5 mm) was promptly covered with the glass tube. Then, the cigarette and glass tube were united by a sealing tape. A filter sample having a length of 20 mm prepared by each of Examples and Comparative Examples was inserted to the empty space (15 mm) of the glass tube. Then, the connect part of the glass tube to the filter was also sealed up by wrapping a sealing tape around the connect part, and each cigarette sample was obtained. A reference cigarette was produced in the same manner as in this method except for using a filter piece having a length of 20 mm cut from the cigarette instead of the filter sample.

[Particle Size]

Using sieves in accordance with JIS Z 8801-1 2006, an aperture size that not less than 90% by weight of the particle passed through was regarded as an upper limit of the particle size, and an aperture size that not less than 90% by weight of the particle failed to pass through was regarded as a lower limit of the particle size.

[Air Resistance]

Concerning filter rods each having a length of 100 mm and cigarette samples obtained in Examples and Comparative Examples, the air resistance was determined as a pressure drop (mmWG) measured by an automatic air-resistance-measuring apparatus ("QTM-6" manufactured by CERULEAN, the U.K.) at an air flow rate of 17.5 ml/second. Since the cigarette samples could not be measured automatically by the apparatus, each of the samples was measured manually.

[Reducing Rate of Phenol]

Concerning each of the cigarette samples and reference cigarette produced in Examples and Comparative Examples, the amount of phenol contained in mainstream smoke by smoking was measured in accordance with Test Method T-114 "Determination of Phenolic Compounds in Mainstream Tobacco Smoke" of Health Canada. Specifically, a particulate matter contained in mainstream smoke of five pieces of cigarette per sample subjected to a smoking machine was collected by a Cambridge filter. The phenol collected in the filter was extracted with 1% acetic acid aqueous solution. The phenol contained in the extract was separated by a reverse phase gradient liquid chromatography, detected by a wavelength-selective fluorometry, and quantitatively determined using a working curve made by highly purified phenol (purity: not less than 99%). Further, the reducing rate of phenol was calculated by the following formula. In the formula, $T_p$ represents the amount of phenol collected from the reference cigarette, and $C_p$ represents the amount of phenol collected from the cigarette sample produced in each of Comparative Examples and Examples.

$$\text{Reducing rate of phenol (\%)}=100\times(1-C_p/T_p)$$

[Filter Hardness (Thickness Retention)]

Concerning the filter rods, each having a length of 100 mm, produced in each of Examples and Comparative Examples, the filter hardness was measured by a hardness testing machine ("QTM7" manufactured by Filtrona). Specifically, the filter hardness (%) was calculated by the following formula. In the formula, when a load of 300 g is vertically applied to a side face of a filter rod, "d" represents a diameter of the filter rod in the load direction after the deformation by the load, and "$d_0$" represents a diameter of the filter rod before the deformation. That is, when the filter rod does not change the shape at all, the hardness is 100%. The closer the hardness gets to 100%, the harder the filter rod is.

$$\text{Filter hardness (\%)}=d/d_0\times100$$

Example 1

A cellulose acetate ("L-40" manufactured by Daicel Chemical Industries, Ltd., acetylation degree of 55.6%) was classified by sieving to give a cellulose acetate particle A having a particle size of "1.0 to 0.425 mm". The cellulose acetate particle A had a bulk specific gravity of 0.40 and a BET specific surface area of 10.8 $m^2/g$. Using a filter rod maker for production of charcoal cigarette filter ("KDF2/AC1/AF1" manufactured by Hauni, Germany), a cellulose acetate fiber tow (total denier: 40000) comprising a filament (2.2 deniers) having a Y-shaped cross section was opened to a width of about 20 cm, and the opened tow was uniformly sprayed with triacetin in a ratio of 6 parts by weight of triacetin relative to 100 parts by weight of the tow and then uniformly sprayed with the cellulose acetate particle A using a charcoal addition mechanism in a ratio of 50 parts by weight of the particle A relative to 100 parts by weight of the tow. The resulting tow was rolled up with a web paper and then cut with a cutter to give a filter rod having a length of 100 mm. The resulting filter rod was further cut to a length of 20 mm to give a filter sample. The filter sample had a BET specific surface area of 3.2 $m^2/g$.

Example 2

A cellulose acetate ("LT-55" manufactured by Daicel Chemical Industries, Ltd., acetylation degree of 60.8%) was classified by sieving to give a cellulose acetate particle B having a particle size of "1.0 to 0.425 mm". The cellulose acetate particle B had a bulk specific gravity of 0.53 and a BET specific surface area of 3.1 $m^2/g$. In the same manner as in Example 1 except for using the cellulose acetate particle B, instead of the cellulose acetate particle A, in a ratio of 70 parts by weight of the particle B relative to 100 parts by weight of the tow, a filter sample was produced. The filter sample had a BET specific surface area of 1.4 $m^2/g$.

Example 3

A cellulose acetate ("LM-80" manufactured by Daicel Chemical Industries, Ltd., acetylation degree of 52.0%) was classified by sieving to give a cellulose acetate particle C having a particle size of "1.0 to 0.425 mm". The cellulose acetate particle C had a bulk specific gravity of 0.29 and a BET specific surface area of 2.5 $m^2/g$. In the same manner as in Example 1 except for using the cellulose acetate particle C, instead of the cellulose acetate particle A, in a ratio of 60 parts by weight of the particle C relative to 100 parts by weight of the tow, a filter sample was produced. The filter sample had a BET specific surface area of 0.9 $m^2/g$.

Example 4

A cellulose acetate ("LL-10" manufactured by Daicel Chemical Industries, Ltd., acetylation degree of 44.3%) was classified by sieving to give a cellulose acetate particle D having a particle size of "1.0 to 0.425 mm". The cellulose acetate particle D had a bulk specific gravity of 0.46 and a BET specific surface area of 4.0 $m^2/g$. In the same manner as in Example 1 except for using the cellulose acetate particle D, instead of the cellulose acetate particle A, in a ratio of 100 parts by weight of the particle D relative to 100 parts by weight of the tow, a filter sample was produced. The filter sample had a BET specific surface area of 2.1 $m^2/g$.

Example 5

A cellulose acetate fiber tow (total denier: 36000) comprising a filament (2.2 deniers) having a Y-shaped cross section was opened to a width of about 20 cm with an apparatus shown in FIG. 1, which was made by improving the filter rod maker for production of charcoal cigarette filter (KDF2/AC1/AF1), and the opened tow was uniformly sprayed with triacetin in a ratio of 6 parts by weight of triacetin relative to 100 parts by weight of the tow and then uniformly sprayed with the cellulose acetate particle A using an addition device in a ratio of 200 parts by weight of the particle A relative to 100 parts by weight of the tow. Then, the tow was opened (jet filled) by an airflow, introduced into a trumpet-shaped collecting tube, and rolled up with a web paper according to a conventional manner. The resulting product was cut with a cutter to give a filter rod having a length of 100 mm. The resulting filter rod was further cut to a length of 20 mm to give a filter sample. The filter sample had a BET specific surface area of 6.8 $m^2/g$.

Example 6

In the same manner as in Example 5 except that a tow having a total denier of 32000 was used instead of the tow having a total denier of 36000 and that the ratio of the cellulose acetate particle A was 300 parts by weight relative to 100 parts by weight of the tow, a filter sample was produced by a jet-filling method. The filter sample had a BET specific surface area of 8.1 $m^2/g$.

Example 7

A cellulose acetate (LL-10) was classified by sieving to give a cellulose acetate particle DF having a particle size of "0.425 to 0.18 mm". The cellulose acetate particle DF had a bulk specific gravity of 0.51 and a BET specific surface area of 5.2 $m^2/g$. In the same manner as in Example 1 except for using the cellulose acetate particle DF, instead of the cellulose acetate particle A, in a ratio of 100 parts by weight of the particle DF relative to 100 parts by weight of the tow, a filter sample was produced by a conventional manner. The filter sample had a BET specific surface area of 2.6 $m^2/g$.

Example 8

A cellulose acetate (L-40) was classified by sieving to give a cellulose acetate particle AF having a particle size of "0.425 to 0.18 mm". The cellulose acetate particle AF had a bulk specific gravity of 0.44 and a BET specific surface area of 12.1 $m^2/g$. In the same manner as in Example 5 except for using the cellulose acetate AF instead of the cellulose acetate A, a filter sample was produced by a jet-filling method. The filter sample had a BET specific surface area of 8.1 $m^2/g$.

Example 9

In the same manner as in Example 6 except for using the cellulose acetate AF instead of the cellulose acetate A, a filter sample was produced by a jet-filling method. The filter sample had a BET specific surface area of 9.2 $m^2/g$.

Comparative Example 1

In the same manner as in Example 1 except that the cellulose acetate particle A was not added, a filter sample was produced. The filter sample had a BET specific surface area of less than the minimum limit of detection (less than 0.1 $m^2/g$).

Comparative Example 2

A cellulose acetate (L-40) was classified by sieving to give a cellulose acetate particle AFF, which passed through a sieve having an aperture size of 0.10 mm. The cellulose acetate particle AFF had a bulk specific gravity of 0.55 and a BET specific surface area of 15.2 $m^2/g$. In the same manner as in Example 6 except for using the cellulose acetate AFF instead of the cellulose acetate A, a filter sample was produced by a jet-filling method. The filter sample had a BET specific surface area of 11.2 $m^2/g$.

Table 1 shows evaluation results of the filters obtained in Examples and Comparative Examples.

TABLE 1

| | Species of cellulose acetate particle and ratio of cellulose acetate particle to 100 parts by weight of tow (parts by weight) | Filter hardness (%) | Air resistance of filter rod (mmWG) | Air resistance of cigarette sample (mmWG) | Reducing rate of phenol (%) |
|---|---|---|---|---|---|
| Example 1 | A: 50 | 90.5 | 430 | 176 | 23 |
| Example 2 | B: 70 | 91.8 | 443 | 179 | 11 |
| Example 3 | C: 60 | 91.0 | 436 | 177 | 10 |
| Example 4 | D: 100 | 93.8 | 461 | 182 | 14 |
| Example 5 | A: 200 | 95.0 | 522 | 194 | 40 |
| Example 6 | A: 300 | 95.5 | 582 | 206 | 48 |
| Example 7 | DF: 100 | 93.2 | 600 | 210 | 16 |
| Example 8 | AF: 200 | 94.3 | 710 | 232 | 46 |
| Example 9 | AF: 300 | 95.0 | 886 | 270 | 52 |
| Comparative Example 1 | 0 | 86.0 | 405 | 170 | 2 |
| Comparative Example 2 | AFF: 300 | — | incapable measurement | 715 | — |

As apparent from the results shown in Table 1, the filters of Examples have a high hardness and a high reducing rate of phenol while maintaining a moderate air resistance. In contrast, the filter of Comparative Example 1, which contains no cellulose acetate particle, has a low reducing rate of phenol, and the filter of Comparative Example 2, which contains a cellulose acetate particle having a small particle size, has a large pressure drop.

What is claimed is:

1. A cigarette filter, comprising:

a cellulose ester tow; and a cellulose acetate particle dispersed in the cellulose ester tow, wherein the cellulose acetate particle has the following particle size: not less than 90% by weight of the cellulose acetate particle pass through a sieve having an aperture size of 1.7 mm and fail to pass through a sieve having an aperture size of 0.10 mm, the sieve is in accordance with JIS Z8801-1 2006, and the cigarette filter has a thickness retention of not less than 90% under a load of 300 g and has an air resistance of not more than 1000 mmWG at an air flow rate of 17.5 ml/second in a filter rod having a length of 100 mm and a diameter of 8 mm.

2. The cigarette filter according to claim 1, further comprising:

a plasticizer, wherein the ratio of the plasticizer is 1 to 10 parts by weight relative to 100 parts by weight of the cellulose ester tow, and the cellulose acetate particle is fixed to cellulose ester tow with the plasticizer.

3. The cigarette filter according to claim 2, wherein the plasticizer comprises an acetin compound.

4. The cigarette filter according to claim 1, wherein the cellulose ester tow comprises a cellulose acetate tow.

5. The cigarette filter according to claim 1, wherein the cellulose ester tow has an average fineness of 10000 to 50000 deniers, and a filament of the tow has an average fineness of 1 to 10 deniers.

6. The cigarette filter according to claim 1, wherein the ratio of the cellulose acetate particle is 100 to 500 parts by weight relative to 100 parts by weight of the cellulose ester tow.

7. The cigarette filter according to claim 1, wherein the cellulose acetate particle has the following particle size: not less than 90% by weight of the cellulose acetate particle pass through a sieve having an aperture size of 1.0 mm and fail to pass through a sieve having an aperture size of 0.18 mm in accordance with JIS Z8801-1 2006.

8. The cigarette filter according to claim 1, wherein the cigarette filter has a BET specific surface area of 0.5 to 10 $m^2/g$.

9. The cigarette filter according to claim 1, wherein the cigarette filter has a reducing rate of phenol of not less than 10% in accordance with Test Method T-114 of Health Canada.

10. The cigarette filter according to claim 1, wherein the cigarette filter is substantially free from a chitosan or a salt thereof.

11. A process for producing a cigarette filter that comprises, a cellulose ester tow; and a cellulose acetate particle dispersed in the cellulose ester tow, wherein the cellulose acetate particle has the following particle size: not less than 90% by weight of the cellulose acetate particle pass through a sieve having an aperture size of 1.7 mm and fail to pass through a sieve having an aperture size of 0.10 mm, the sieve is in accordance with JIS Z8801-1 2006, and the cigarette filter has a thickness retention of not less than 90% under a load of 300 g and has an air resistance of not more than 1000 mmWG at an air flow rate of 17.5 ml/second in a filter rod having a length of 100 mm and a diameter of 8 mm, the process comprising:

a step for adding a cellulose acetate particle to an opened cellulose ester tow.

12. The process according to claim 11, wherein the cellulose acetate particle is added to a preliminarily opened cellulose ester tow, and then the cellulose ester tow is further opened by an airflow.

13. A cigarette provided, comprising:

a cigarette filter that includes, a cellulose ester tow; and a cellulose acetate particle dispersed in the cellulose ester tow, wherein the cellulose acetate particle has the following particle size: not less than 90% by weight of the cellulose acetate particle pass through a sieve having an aperture size of 1.7 mm and fail to pass through a sieve having an aperture size of 0.10 mm, the sieve is in accordance with JIS Z8801-1 2006, and the cigarette filter has a thickness retention of not less than 90% under a load of 300 g and has an air resistance of not more than 1000 mmWG at an air flow rate of 17.5 ml/second in a filter rod having a length of 100 mm and a diameter of 8 mm.

* * * * *